US009418635B1

(12) United States Patent
Bedlington

(10) Patent No.: US 9,418,635 B1
(45) Date of Patent: Aug. 16, 2016

(54) RETROFITTABLE CLOSED-LOOP HEATER SYSTEM FOR MOUTHPIECE OF BRASS WIND MUSICAL INSTRUMENT

(71) Applicant: Donald Bedlington, Olympia, WA (US)

(72) Inventor: Donald Bedlington, Olympia, WA (US)

( * ) Notice: Subject to any disclaimer, the term of this patent is extended or adjusted under 35 U.S.C. 154(b) by 0 days.

(21) Appl. No.: 14/998,761

(22) Filed: Feb. 11, 2016

(51) Int. Cl.
*G10D 9/02* (2006.01)

(52) U.S. Cl.
CPC ..... *G10D 9/02* (2013.01)

(58) Field of Classification Search
CPC ..... G10G 5/005; G10G 5/00; G10G 7/005; G10D 3/00; G10D 1/08; G10D 3/18; G10D 13/026; G10D 1/005; G10D 13/003; G10D 13/06; G10D 3/06; G10D 13/02; G10D 3/02; G10D 3/14; G10D 13/00; G10D 13/021
USPC ..... 84/453, 327
See application file for complete search history.

(56) References Cited

U.S. PATENT DOCUMENTS

2014/0090547 A1* 4/2014 Udell, III ..... G10H 1/0091 84/626

* cited by examiner

*Primary Examiner* — Kimberly Lockett
(74) *Attorney, Agent, or Firm* — Michael A. Kaufman, Esq.

(57) ABSTRACT

A heater system for the mouthpiece of a musical brass instrument includes a heater element and a heat sensor, both in thermal proximity to the mouthpiece, closed-loop electronic circuitry coupled to the heater element and heat sensor, and a battery power source. The musician playing the mouthpiece uses a control to adjust desired mouthpiece temperature. The circuitry compares musician adjusted temperature to heat sensor detected mouthpiece temperature and controls electrical current through the heater element to adjust mouthpiece temperature as required. The heater system preferably fits within a cylindrical-shaped housing having a central opening through which the mouthpiece fits. In practice the mouthpiece is removed from the instrument leadpipe, is passed through the central opening of the housing, and reinserted into the leadpipe. A battery supply may be attached to the instrument to couple battery operating power through a cable to the circular housing and components within.

20 Claims, 3 Drawing Sheets

RETROFITTABLE CLOSED-LOOP HEATER SYSTEM FOR MOUTHPIECE OF BRASS WIND MUSICAL INSTRUMENT

FIELD OF THE INVENTION

The invention relates to brass wind musical instruments that have metal mouthpieces and must be played at times in cold weather. More specifically, the invention relates to a retrofitable heater system to controllably and dynamically warm the mouthpiece of such an instrument, for the comfort of the musician playing the instrument in cold weather.

BACKGROUND OF THE INVENTION

Brass musical instruments include without limitation the bugle, trumpet, cornet, flugel horn, piccolo trumpet, French horn, trombone, baritone, euphonium, and tuba. Such instruments typically terminate in a hollow leadpipe, into which a metal mouthpiece is inserted. While playing the brass musical instrument, the musician's lips are pressed against the mouthpiece. Often such instruments must be played outdoors in cold or even freezing weather. For example, the musician and instrument might be part of a marching band that is called upon to play outdoors in all seasons, perhaps a military band that plays martial music at funerals in winter. Playing brass instruments in extremely cold temperatures is very uncomfortable to the musician. The lips may become so cold and numb while blowing into the metal mouthpiece as to interfere with good playing of the instrument, and may even suffer injury.

Attempts to insulate the musician's lips from the often freezing cold temperature of the instrument mouthpiece may include pre-heating the mouthpiece before it is inserted into the hollow projecting leadpipe portion of the instrument. However this is not always practical and once the mouthpiece is inserted into the leadpipe and the instrument is exposed to cold temperature, the mouthpiece temperature will drop to ambient temperature. Another remedy is to apply lip balm to the musician's lips, to provide a small measure of thermal insulation from the cold mouthpiece of the instrument. However the lip balm provides minimal thermal protection for the musician, and can wear away as the instrument is played. These are stop gap measures at best, and are not very effective for long durations of music playing in very cold temperatures. Some musicians use plastic mouthpieces to improve lip comfort in cold weather playing, but such mouthpieces degrade the quality of the music.

What is needed is a heater system for use with the metal mouthpiece of a brass wind music instrument. Such heater system should controllably warm the instrument mouthpiece at a temperature comfortable to the musician, and should maintain a musician determined temperature for hours, even it the instrument is played in extremely cold, varying ambient temperature. The heater system preferably should be entirely self-contained such that no external preheating is required, and should not require the use of chemical lip balms or the like. The heater system should be retrofittable to existing musical instruments and should be portable. Preferably such heater should allow the musician to vary the desired temperature of the instrument mouthpiece in closed-loop fashion, even while the instrument is being used, which desired temperature should then be maintained, even in changing ambient temperature.

The present invention provides such a heater system.

SUMMARY OF THE PRESENT INVENTION

The present invention provides a retrofittable removably attachable standalone heater system to controllably heat the mouthpiece of a brass musical instrument. The heater system, except for its battery power supply, preferably is disposed on a flexible printed circuit board that is curved to fit within a cylindrical housing that has an opening at each end. Preferably regions of the interior housing surface are made thermally insulating so that heat produced within by the heater system does not readily escape through the housing wall. The opening in the housing rear is sized to pass the diameter of the mouthpiece rear narrow end region, and the housing front diameter is sized to fit snugly about an enlarged first region of the mouthpiece. In use, the mouthpiece rear narrow end region is passed coaxially through the housing, from housing front to rear, and the housing is abutted against the enlarged first region of the mouthpiece. A portion of the mouthpiece rear narrow end that projects through the housing rear opening is slid coaxially into the musical instrument leadpipe.

During manufacture of the present invention, airspace within the housing that surrounds the heater system preferably is filled with a thermally conductive elastomer. The manufacturer can insert coaxially though the housing openings a duplicate of the mouthpiece for the instrument type and model with which the assembled heater system will be used, and then fill the airspace within the housing with the elastomer Alternatively, instead of using an actual mouthpiece, the manufacturer may use a cylindrical-shaped jig whose exterior diameter matches that of the mouthpiece with which the finished heater system will be used. With the jig in place, airspace within the housing is filled with elastomer. In either manufacturing step, the elastomer is allowed to cure, and will hold the printed circuit board and components thereon securely within the housing.

After curing is complete, the manufacturer slides the mouthpiece or jig forward, out of the housing front. The cylindrical housing now contains the heater system, and a cylindrical void, coaxial with the housing longitudinal axis, which void is surrounded by cured elastomer. As described below, when used with an instrument, the elastomer enhances transfer of heat from the heater system to exterior surface portions of the mouthpiece. In use, the rear narrow end region of the actual mouthpiece is inserted through the housing front, through the cylindrical void within, and through the housing rear opening. At least a portion of the mouthpiece narrow rear end that projects out from the housing rear is slid coaxially into the leadpipe attached to the musical instrument. An optional stop clamp is attached to the mouthpiece end portion adjacent the rear of the cylindrical housing the narrower mouthpiece region to prevent lateral movement of the heater housing toward the rear of the musical instrument. Such movement is undesired and could impair good bonding and good thermal conductivity between the elastomer surrounding the cylindrical void and the outer surface of the mouthpiece the elastomer contacts. The combination of an insulating housing interior surface, and the use of elastomer help promote efficient transfer of heat generated by the heater system to at least a portion of the outer surface of the instrument mouthpiece, with minimal loss of heat through the cylindrical housing outer surface. This efficiency can extend lifetime of the battery used to power the heating system. Once so mounted, it is preferred that the heater system remain on the mouthpiece indefinitely.

As noted, the cylindrical heater housing contains battery powered electronic circuitry, preferably disposed on a flexible printed circuit board curved to fit within the housing. The electronic circuitry includes a thermal sensor that is in close thermal proximity to the mouthpiece and to a heater element of resistance R, also disposed within the housing. The electronic circuitry creates and controls an electrical current i(t) that flows through heater element R, which radiates heat proportional to $i(t)^2 \cdot R$. It is this heat, conducted at least in part via the elastomer, that heats the mouthpiece. As noted, heat loss through the housing exterior surface preferably is reduced by thermally insulating the housing interior surface, especially if the housing material happens to be a good heat conductor, such as metal.

In a preferred embodiment, the electronic circuitry dynamically compares a first parameter proportional to desired mouthpiece temperature against a second parameter proportional to actual mouthpiece temperature. The first parameter is preferably a fixed reference signal, perhaps a voltage level. The second parameter a signal determined by the thermal sensor, whose resistance changes with sensed temperature. Overall magnitude of the second parameter preferably is controllable in part by the musician, for example by varying a resistance in series with the thermal sensor. In closed-loop fashion these two parameters are dynamically compared using, for example, a differential input operational amplifier.

If the sensed mouthpiece temperature is too low, the circuitry automatically increases magnitude of current i(t), which causes the heating element to radiate more $i(t)^2 \cdot R$ heat, which further heats the mouthpiece. However, if sensed mouthpiece temperature is too high, the circuitry automatically causes the heating element to radiate less $i(t)^2 \cdot R$ heat, which allows the mouthpiece to grow somewhat cooler. Preferably the heat radiator is a resistance R through which electrical current i(t) is controllably caused to pass or not pass. Magnitude of i(t) is determined by closed-loop positive feedback operation of the circuitry, which controls a transistor whose output current is i(t), and preferably is either a high maximum value or a zero minimum magnitude at any given time. The musician playing the instrument can adjust the desired temperature of the mouthpiece using a control knob or the like, preferably disposed on the heater housing, to vary the second parameter. Such adjustment may be made at any time. The preferably closed-loop operation advantageously reduces power consumption for the heat generating electronics, and also allows the musician to concentrate on playing music rather than on constantly readjusting heat generation in an open loop heater system.

Electrical operating power for the electronic circuitry is provided by at least one battery, preferably disposed in a detached power supply housing. The power supply housing preferably may be attached to the leadpipe of the instrument using Velcro® or the like, with operating power coupled from the power supply to the heater housing via an electrical cable. If desired, however, the battery could be disposed within the housing that contains the remainder of the heater system.

Brass musical instruments with which the invention may be used include without limitation the trumpet, cornet, flugel horn, piccolo trumpet, French horn, trombone, baritone, euphonium, and tuba.

Other features and advantages of the invention will appear from the following description in which the preferred embodiments have been set forth in detail, in conjunction with their accompanying drawings.

DETAILED DESCRIPTION OF THE PREFERRED EMBODIMENT

Figure 1:
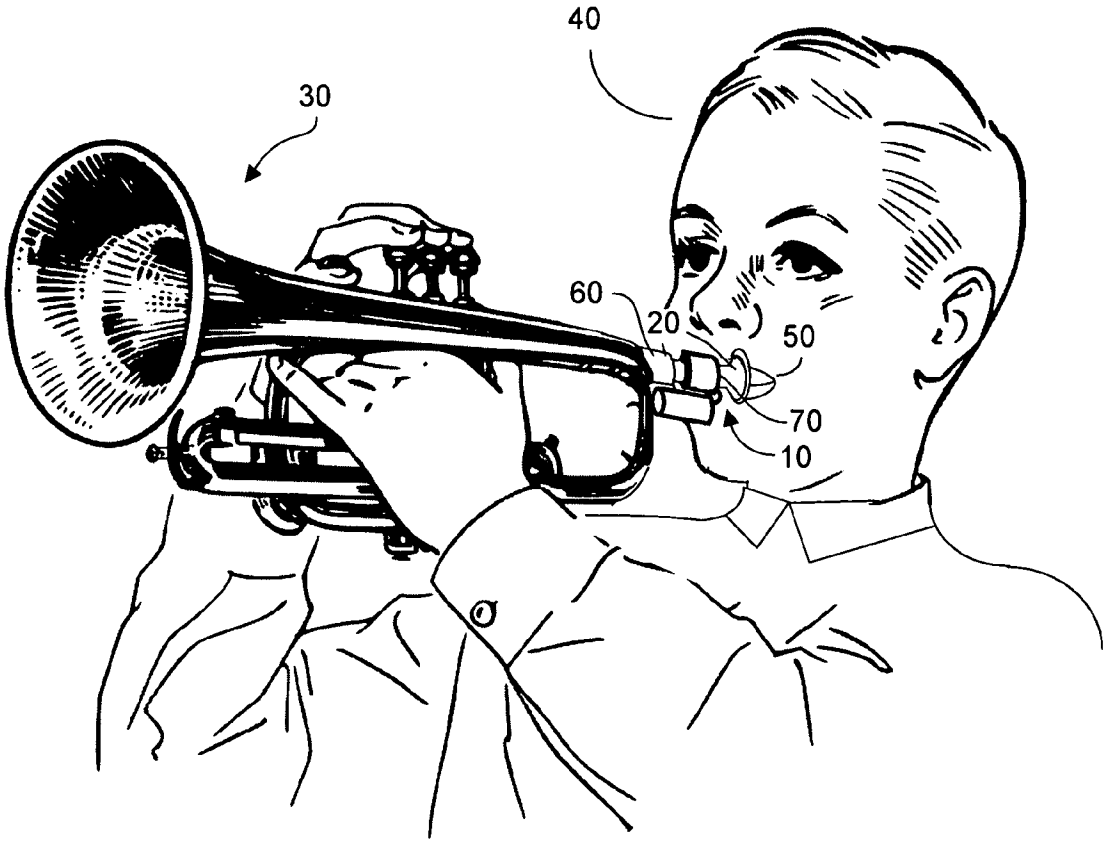
FIG. 1 depicts a musician using a brass wind musical instrument, a trumpet, whose mouthpiece is equipped with a heater system, according to embodiments of the present invention.

FIG. 1 depicts a heater system 10, according to embodiments of the present invention, used to heat mouthpiece 20 of a brass wind musical instrument 30, here a trumpet. It is understood that musician 40 presses lips 50 against metal mouthpiece 20 to play music with instrument 30. Although FIG. 1 depicts instrument 30 as being a trumpet, other brass wind musical instruments with which the present invention 10 may be used include, without limitation, a cornet, a flugelhorn, a piccolo trumpet, a French horn, a trombone, a baritone, a euphonium, and a tuba. Each of these instruments has a metal leadpipe 60 into which metal mouthpiece 20 is coaxially inserted during play or removed as desired. The problem common to these brass wind instruments is that metal is an excellent thermal conductor. Consequently, the musician's lips can become uncomfortably cold pressed against a metal mouthpiece when such instruments are played in extremely cold ambient temperature, outdoors in winter, for example.

Figure 2:
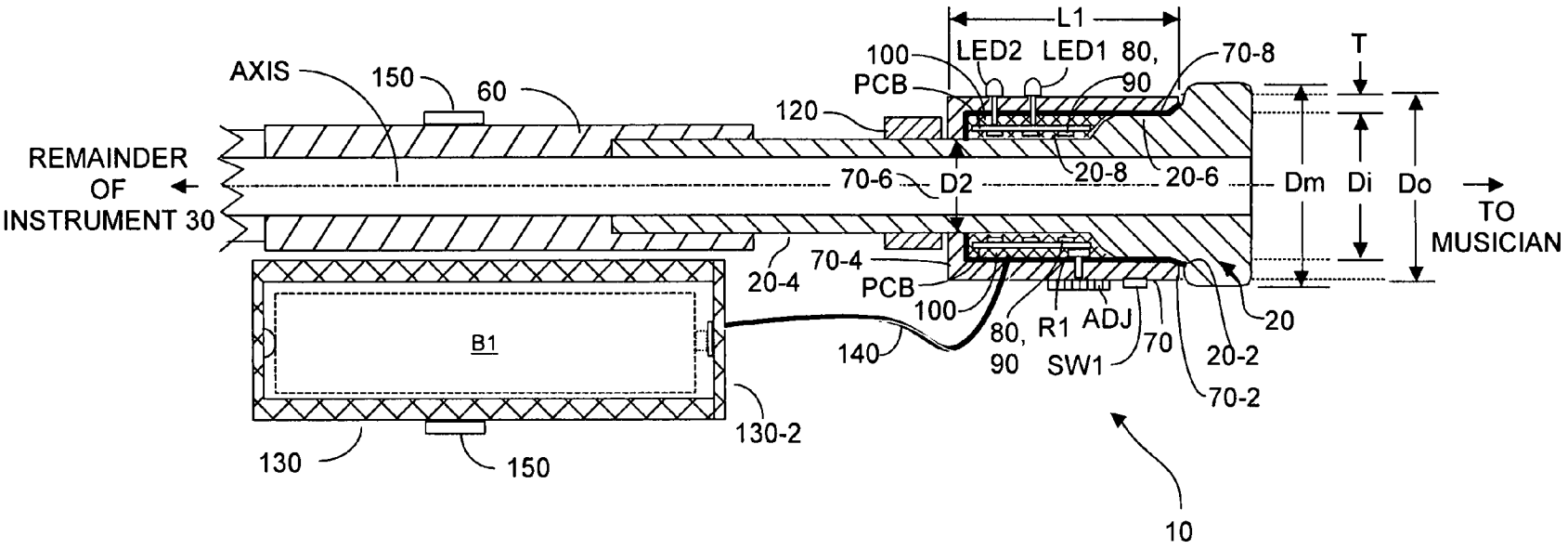
FIG. 2 is a lengthwise cross-sectional side view of an exemplary closed-loop heater system for a brass wind musical instrument, according to embodiments of the present invention.

As best seen in FIG. 2, mouthpiece 20 typically has a largest diameter Dm region 20-2 that faces the musician during play. Mouthpiece 20 further has an elongated end region 20-4 that extends rearward (right-to-left in FIG. 2) several inches with outer diameter Do, and an intermediate necked-down transition region 20-6 between regions 20-2 and 20-4. Most of heater system 10 preferably is disposed within a cylindrical housing 70 that fits coaxially about and in good thermal proximity to at least a portion of the external surface of necked down transition region 20-6 and elongated region 20-4 of mouthpiece 20. As will be explained, heat generated within housing 70 by heater system warms surface region 20-8 and transition region 20-6, and thus regions of metal mouthpiece 20 contacted by the musician's lips while playing the instrument. Note that when coaxially mounted, housing 70 shares a common longitudinal axis (AXIS) with leadpipe 60 and mouthpiece 20.

Referring still to FIG. 2, cylindrical housing 70 has a front open first end 70-2 facing the musician, and a rear second end region 70-4 that has a central opening 70-6 of diameter D2. Diameter D2 is sized to be slightly larger than the diameter of the elongated narrow region 20-4 of mouthpiece 20, which must pass through central opening 70-6 in end region 70-4. For ease of illustration, housing 70 is depicted as having a flat shaped second end region 70-4. However if housing 70 is produced by drawing or molding, region 70-4 can be rounded, i.e., convex facing instrument 30.

Housing 70 has outer diameter Do, inner diameter Di, and a housing wall thickness T, and housing length L1. Table 1 below sets forth exemplary dimensions for cylindrical housing 70 for various types of brass wind musical instruments 30, with which embodiments of the present invention may be used. In preferred embodiments, cylindrical housing 70 is fabricated from a polished metal, brass for example, so as not to detract from the physical appearance of the musical instrument with which it is used. Battery housing 130 may be fabricated from similar material, for the same esthetic reason.

TABLE 1

| Musical Instrument | Do (inches) | D2 (inches) | L1 (inches) |
|---|---|---|---|
| Trumpet, Bugle, Cornet, Flugelhorn, Piccolo trumpet, French Horn | 1.0 | 0.5 | 1.5 |
| Trombone, Baritone, Euphonium | 1.5 | 0.5 | 1.5 |
| Tuba, Sousaphone | 1.6 | 0.6 | 2.0 |

Typically housing 70 is made of metal, brass perhaps, although a molded plastic material may instead be used. Preferably the exterior surface of housing 70 is finished to match the color and finish appearance of instrument 30, for aesthetic reasons. In embodiments for which material comprising housing 70 is a good thermal conductor, e.g., metal, preferably a layer of heat insulating foam tape 70-8 or the like is attached to the inner housing surface to enhance thermal insulation of the inner surface. As such, material 70-8 minimizes loss of element R heat generated within housing 70 through the exterior housing surface. This feature allows more heat to remain within the interior of housing 70 to warm mouthpiece exterior surface 20-8, and thus metal mouthpiece 30. This enhanced thermal efficiency advantageously reduces power demand on the heat generating electronics and the battery power supply, which allows battery B1 to function longer before recharging or replacement.

Applicant has found that filling air space within cylindrical housing 70 with a heat conducting material 100, shown as crosshatch in FIG. 2, during manufacture enhances good heat transfer from element R to mouthpiece 20. Material 100 promotes thermal conductivity and enhanced thermal proximity between heat generating element R (or 80) and at least a portion of mouthpiece 20, especially region 20-8. An exemplary such heat conducting material 100 is silicon elastomer SS-2204 or SS-2005, available from Silicone Solutions of Cuyahoga Falls, Ohio 44224

In practice, during manufacture of the present invention, a substitute mouthpiece similar in dimension to mouthpiece 20 (see FIG. 2 and Table 1, herein) with which the completed heater system will be used, or a mouthpiece jig, perhaps a cylinder of exterior dimension D2, is used. Before introducing elastomer 100, the substitute mouthpiece or jig, preferably is coated with a mold release, and is then inserted coaxially through the housing front opening with a portion of the substitute mouthpiece or jig projecting out opening 70-6 in the housing rear, along a common longitudinal AXIS, as shown in FIG. 2. The airspace in the interior of housing 70 is now filled with elastomer 100, and the substitute mouthpiece or jig is pushed into the housing (or vice versa) to emulate what is shown in FIG. 2. The elastomer is then allowed to cure, e.g., at room temperature for perhaps two hours. It is understood that element R, and electronic components comprising circuitry 90 and their curved PCB are already within housing 70. Further, openings through the housing wall will have been drilled, as needed, to permit light from the LEDs, if used, to be seen, and to pass the shaft of potentiometer R1 so that a knob, ADJ, can be connected to the external, distal, shaft end; see FIG. 2. One role of elastomer 100 is to secure curved PCB and the components thereon securely within the housing interior. The other role is of course to enhance good transfer of heat generated within the housing interior to the exterior surface regions of mouthpiece 20 that in practice will be contacted by the cured elastomer.

Once the elastomer has cured, the manufacturer will carefully slide the substitute mouthpiece or jig out of the housing. Using FIG. 2 as an analogy, the substitute mouthpiece or jig would be slid out in a left-to-right direction. The use of a mold release pre-curing can facilitate easier removal of the substitute mouthpiece or jig without damage to the cured elastomer. At this juncture, housing 70 has the PCB and components within, anchored by the cured elastomer. Controls such as the ADJ knob on the shaft of potentiometer R1, LEDs, etc. will protrude through the housing wall, as shown in FIG. 2. Extending along the longitudinal AXIS of housing 70 will be a cylindrical void that was previously occupied by the region of the substitute mouthpiece or jig that was surrounded by elastomer. The manufacturer has a completed heater assembly that can be marketed for use with a specific type mouthpiece that is used on specific model instruments. Thus, it will be appreciated that the present invention is retrofittable and may be used with existing musical instruments lacking a mouthpiece heating capability.

The musician buying the completed heater system suitable for the brass wind instrument in question will carefully insert the actual mouthpiece 20 for instrument 30 into the housing, inserting right-to-left, referring to FIG. 2. Mouthpiece elongated narrow end region 20-4 is first inserted through the large opening at the front of housing 70, into the cylindrical void defined by the absence of elastomer 100 within the housing, and then out through opening then slid through housing 70, and back into leadpipe 60, (slid right-to-left) in FIG. 2, coaxially along the common longitudinal axis (AXIS). The larger Do diameter opening of cylindrical housing 70 is abutted against the inner portion adjacent largest mouthpiece diameter Dm region 20-2. The elastomer binds and seems to form annular rings that secure the elastomer to at least portions of surface region 20-8 of mouthpiece 20.

Optionally a small tube of thermal grease such as is available from vendors like Radio Shack®, Amazon®, and the like can be provided with the present invention. Such thermal grease commonly is used to enhance heat transfer between transistors and their heatsinks, and computer processor chips and their heatsinks. A similar function will occur here. A small dab of thermal grease can be spread on the exterior mouthpiece surface that will be contacted by the cured elastomer 100, to enhance heat transfer between the elastomer and the relevant mouthpiece surface regions A spring-loaded or other clamp 120 is then attached to region 20-4 of the mouthpiece, adjacent housing end 70-4, to retard lateral movement of housing 70 rearward (right-to-left in FIG. 2) along the mouthpiece. Such lateral movement could disadvantageously degrade quality of the physical binding between elastomer 100 and at least surface region 20-8 of the mouthpiece, and thus degrade efficient transfer of generated heat to mouthpiece 20.

Housing 70 (with electronic components within) can remain on mouthpiece 20 for a long time, e.g., several years, especially as the weight of housing 70 and components within is relatively nil, and preferably the housing exterior matches the finish of instrument 30. Repeatedly removing and reinserting mouthpiece 20 from or through housing 70 would break the desired good thermal seal between mouthpiece surface region 20-8 and the cured elastomer material 100. It is understood that a good thermal seal promotes more efficient thermal transfer and heat generated within the housing to the mouthpiece, which efficiency can extend lifetime of the battery used to power the electronics within housing 70.

As will now be described, ohmic heat electrically generated within housing 70 by system 10 controllably heats mouthpiece 20 for the comfort of musician 40. Ohmic heat refers to heat generated and radiated by controllably passing electrical current i(t) through a resistive heater element 80 having resistance R, perhaps a length of Nichrome wire or at least one resistor. Radiated ohmic heat is conducted to at least portions of the mouthpiece and is what controllably elevates and maintains temperature of mouthpiece at a desired temperature set by musician 40, e.g., by using the ADJ knob to vary effective resistance of potentiometer R1.

As also shown in FIG. 2, system 10 includes a portable power supply, preferably at least one battery B1 disposed within power supply housing 130, and accessible via housing door 130-2. DC operative power from B1 is coupled electrically via cable 140 to circuitry components comprising circuitry 90 (see FIG. 3) within housing 70. Power supply housing 130 may be removably attached to leadpipe 30 of instrument 30 using a Velcro® strap 150 or the like. Of course if housing 70 were suitably enlarged, battery B1 could be disposed within the housing, thus obviating the need for a separate battery supply housing 130.

Figure 3:
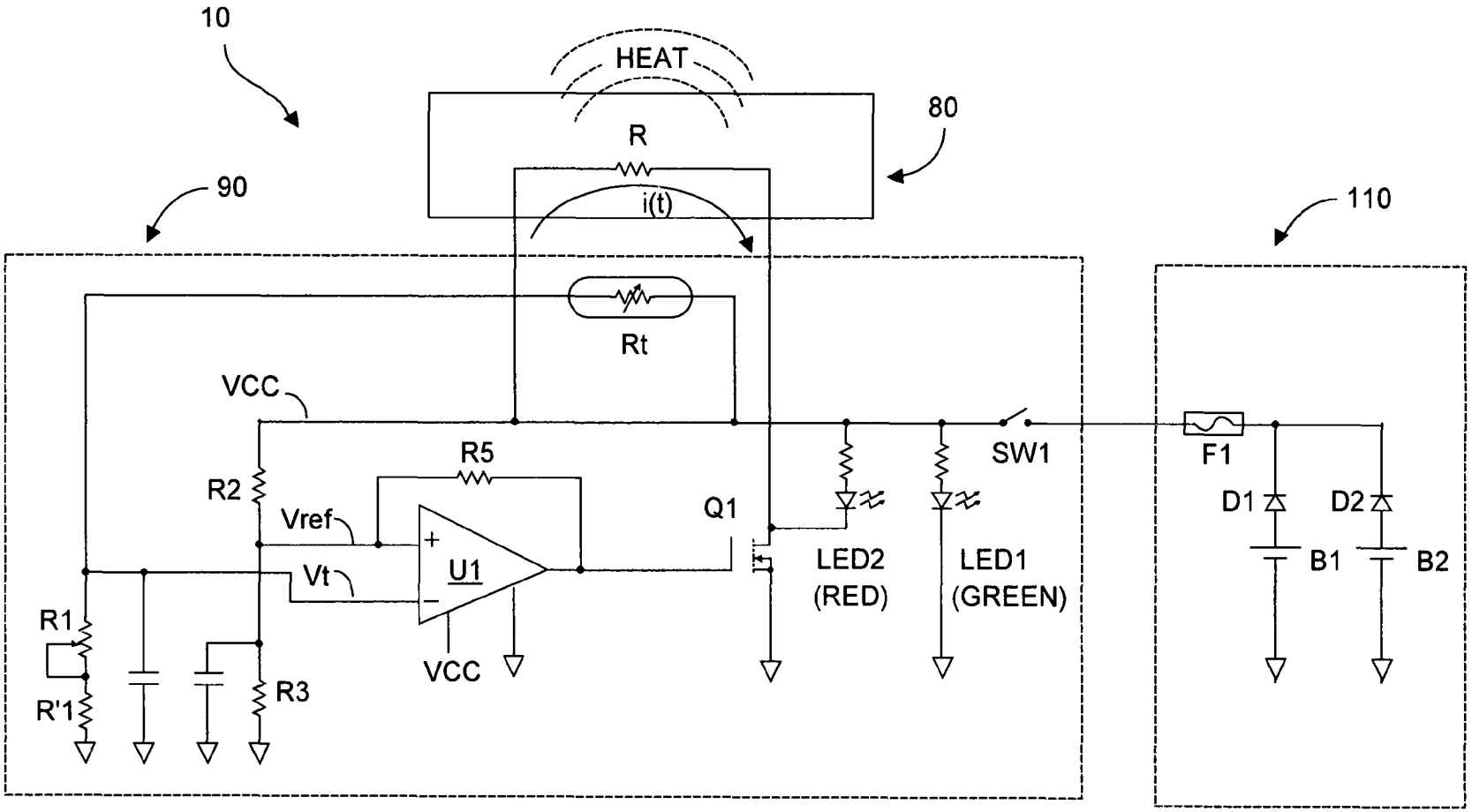
FIG. 3 is an exemplary schematic of a closed-loop heater system for a brass wind musical instrument, according to embodiments of the present invention.

Referring now to FIG. 3, an exemplary electronic implementation of system 10 is shown as comprising an ohmic heat generating element 80 (also denoted R), electronic circuitry components, collectively circuitry 90, mounted on a flexible curved printed circuit board (PCB), and a power source 110. Heating element 80, or R, has resistance R, and is disposed in close physical and thermal proximity to at least a portion of mouthpiece 20, e.g., surface region 20-8. Responsive to current flow i(t) from circuitry 90, which is powered from power source 110, resistive heater element R radiates heat (shown as waves denoted HEAT) proportional to $i(t)^2 \cdot R$ to controllably warm at least a portion of mouthpiece 20. In one embodiment R was about 2Ω and was implemented using a coiled length of several inches of 30 gauge Nichrome wire, wound within cylindrical housing 70, with windings spaced to occupy much of housing length L1. In another embodiment, R was implemented using several 0.5Ω resistors whose series-connected resistance was about 2Ω. The resistors may be surface mounted components, and in any event are mounted on a curved flexible printed circuit board PCB and preferably spaced to occupy most of the internal length of housing 70, to more uniformly radiate heat across mouthpiece region 20-8. It will be appreciated that the outer surface of mouthpiece 20 is itself cylindrical, and that use of a curved PCB within cylindrical housing 70 enables the heat generating components, a length of Nichrome wire, and/or a series of spaced-apart resistors, to be disposed spaced-apart cylindrically, which improves efficiency of heat transfer from R to the outer surface of mouthpiece 20. More efficient heat transfer from heat generator 80 (or R) enables a single battery B1 to power circuitry 90 to warm mouthpiece 20 for more hours of continuous use in inclement weather than would otherwise be possible. The electronic components comprising circuitry 90 may be implemented using surface mount devices (SMD), for ease of circuit layout on the PCB.

In FIG. 3, power supply 110 provides DC voltage VCC and preferably includes at least one lithium ion type 18650 3.7 V battery B1. Two such batteries B1, B2 are shown in FIG. 3 with series diodes D1, D2. In such embodiment whichever B1, B2 battery has the higher voltage will power circuitry 90, with diodes D1, D2 preventing the higher voltage battery from trying to charge the remaining battery, and guarding circuitry 90 against reverse polarity should B1 be inserted backwards in housing 130. A protective fuse F1, perhaps two amps or so, protects both batteries and circuitry 90 from damage in case of an electrical short. In practice a single 18650 3.7 V battery B1 can comfortably provide several amps A of current i(t) to maintain temperature of mouthpiece 20 between about 80° F. and about 90° F., as set by the musician, perhaps about 5 W to 10 W of heat. Switch SW1 enables the musician to turn system 10 ON or OFF and preferably is mounted within cylindrical housing 70, with a protruding lever. When SW1 is in the ON position, current flows through optional green LED1 to confirm visually to the musician that power is indeed on. Optional red LED2 confirms visually to the musician that circuitry 90 is working and that heat is being generated. In typical use, the green LED1 remains on, and red LED2 will come on and off as the electronic circuitry causes more or less (e.g., no) current i(t) to flow through element R. Resistors shown in series with LED1, LED2 provide a protective current limiting function As soon as SW is ON, current will flow through LED1, and the green LED turns on, to confirm power is applied to the circuitry. U1 is a generic operational amplifier that is operated in closed-loop fashion to compare two input DC voltages, Vref and Vt. Resistor R5 provides positive feedback to help ensure that the output of U1 is either fully high or fully low, rather than at some intermediate indeterminate level. This in turn will cause MOSFET Q1 to be fully on, in which case i(t) is maximum, or fully off, in which case i(t) is zero.

The non-inverting input (+) of U1 sees a fixed or first reference voltage Vref that is a fraction of power supply voltage VCC, the fraction determined by a first resistor divider comprising resister R2 in series with resistor R3. R3 preferably is bypassed with a capacitor to help stabilize U1 by bypassing transients. The inverting (−) input of U1 sees a second voltage Vt that is a fraction of VCC determined by a second resistor divider comprising thermistor Rt and, collectively, potentiometer R1 in series with scaling resistor R1'. Collectively R1+R1' are bypassed with a capacitor to enhance stability of U1.

Thermistor Rt, preferably is in close thermal proximity to R, and potentiometer R1 is in series with scaling resistor R1'. In a preferred embodiment, as thermistor Rt heats up due to its thermal proximity to R, its internal resistance decreases. Note that at increasing temperatures, as magnitude of thermistor Rt decreases, magnitude of voltage Vt increases.

If mouthpiece 20 is too cold for the musician, then Vref>Vt, and if the mouthpiece temperature is too high, the Vref<Vt. When Vref>Vt, the output of U1 will be high, which will turn-on FET Q1, which will cause LED2 to turn on, which red glow visually assures the musician that heat is being generated. When Q1 is turned on, it conducts an increased magnitude time-varying current i(t), which also flows through heating element R (or 80). R will then radiate heat proportional to $i(t)^2 \cdot R$. Since R is in thermal proximity to mouthpiece 20, especially when thermally conductive silicon elastomer 100 is employed, the heat it radiates will increase temperature of the mouthpiece. If however Vref<Vt, the output of U1 will be low, which will turn off FET Q1, reducing magnitude of current i(t) to essentially zero. R will now radiate less heat, e.g., it does not cool down instantaneously, and the temperature of mouthpiece 20 will decrease. It is seen that Q1 operates digitally in a full-on or full-off mode, and that i(t) may be described as pulse-width modulated. When Q1 it turned fully-on, although i(t) is maximum, voltage across Q1 is nil, and heat dissipation in Q1 is nil. In addition, when Q1 is turned fully off, voltage across Q1 is VCC but i(t) is zero, and again heat dissipation in Q1 is nil. In this mode of operation, Q1 dissipates little power, and a lower power device may be used for Q1 than would otherwise be the case.

Further, a preferred closed-loop mode of operation prolongs battery life, as effective duty cycle of operation is substantially less than 100%.

Of course one could operate embodiments of the present invention without closed-loop feedback, although such embodiments would require the musician to frequently readjust the level of heat desired, as ambient temperature changed, and as battery condition depleted. In addition, closed-loop operation can lengthen the operating time for battery B1 before recharging or battery substitution is required. In general the advantages of closed-loop operation substantially outweigh the slight additional cost of more electronic components.

In a preferred embodiment, potentiometer R1 is mounted within cylindrical housing 90 with its shaft protruding through the housing wall, and with a knob (AJD) affixed to the shaft end, as shown in FIG. 2. Thus at any time the musician may adjust the knob (ADJ) on potentiometer R1 to dynamically increase or decrease the temperature off the mouthpiece as desired. The musician can leave the ADJ knob alone as ambient temperature changes, because the closed-loop operation of circuitry 90 will automatically correct i(t) as required. If desired, ON/OFF switch SW1 could use the same shaft as potentiometer R1, such that at full counterclockwise, SW1 is OFF, and turning the shaft clockwise turns SW1 ON and varies magnitude of R1. For use in cold weather, the musician will typically turn SW1 ON perhaps fifteen minutes before the musical instrument will be played, to allow mouthpiece 20 to be heated up to a desired temperature by system 10 before use.

As described, embodiments of the present invention provide a retrofitable heater system that may be affixed to the mouthpiece of a brass musical instrument without modification of the instrument. Preferred embodiments include electronic circuitry that enables the musician playing the instrument to dynamically control mouthpiece temperature at any time, even while playing the instrument. A closed-loop feedback aspect of the invention enables the heater system to maintain a desired temperature, even if ambient temperatures changes while the instrument is being used, or even if battery B1 voltage begins to drop. Optional LEDs provide confirmation to the musician that the heater system has been turned on, and is indeed generating heat. When play for many hours in very cold weather is anticipated, the musician may carry one or more pre-charged extra batteries B1. At a lull in the music play, battery compartment access door 130-2 may be quickly opened, and a fresh battery substituted for the depleted battery. Alternatively, power supply housing 130 may house more than one battery, with batteries used in parallel to extend battery operating time.

Modifications and variations may be made to the disclosed embodiments without departing from the subject and spirit of the invention as defined by the following claims.

What is claimed is:

1. A retrofittable heater system for use with a musical brass instrument that has a metal mouthpiece slidably removable from a leadpipe connected to the instrument, the heater system comprising:

an ohmic heat generating element, disposed in thermal proximity to at least a portion of said mouthpiece, to generate heat when coupled to an appropriate power source delivering current i(t);

means for monitoring temperature of at least a portion of said mouthpiece, said means for monitoring thermally coupled to at least a portion of said mouthpiece;

means for comparing temperature of at least a portion of said mouthpiece with a musician desired temperature, said means for comparing causing a current flow i(t) through said ohmic heat generating element to vary temperature of said mouthpiece as needed in closed-loop operation.

2. The heater system of claim 1, wherein said ohmic heat generating element is selected from a group consisting of a length of Nichrome wire, and at least one resistor.

3. The heater system of claim 1, wherein said means for monitoring temperature includes a thermistor.

4. The heater system of claim 1, wherein said means for comparing includes a differential operational amplifier whose output signal governs magnitude of said current flow i(t).

5. The heater system of claim 1, further including a cylindrical shaped housing defining a first opening at a front end and defining a second opening at a rear end of said cylindrical shaped housing, in which cylindrical shaped housing is disposed said ohmic heat generating element, said means for monitoring temperature, and said means for comparing, said mouthpiece being inserted through said first opening and out said second opening such that said cylindrical housing is disposed coaxially about said mouthpiece along a longitudinal axis of said mouthpiece;

said cylindrical shaped housing having an interior surface and an exterior surface, said interior surfacing retarding loss of heat from within said cylindrical shaped housing to said exterior surface thereof.

6. The heater system of claim 5, further including a flexible printed circuit board sized to fit curved within said cylindrical shaped housing, wherein at least said ohmic heat generating element is mounted on said flexible printed circuit board.

7. The heater system of claim 6, wherein said at least said means for monitoring temperature and said means for comparing are mounted on said flexible printed circuit board.

8. The heater system of claim 5, further including a heat conductive elastomer that fills air space within said cylindrical shaped housing.

9. The heater system of claim 6, further including a heat conductive elastomer that fills air space within said cylindrical shaped housing.

10. The heater system of claim 7, further including a heat conductive elastomer that fills air space within said cylindrical shaped housing.

11. The heater system of claim 1, wherein said brass musical instrument is selected from a group consisting of a bugle, a trumpet, a cornet, flugel horn, a piccolo trumpet, a French horn, a trombone, a baritone, a euphonium, and a tuba.

12. The heater system of claim 1, further including said power source, electrically coupled to said ohmic heat generating element, said means for monitoring temperature, and said means for comparing temperature.

13. A retrofittable heater system for use with a musical brass instrument that has a metal mouthpiece slidably removable from a leadpipe connected to the instrument, the heater system comprising:

a cylindrical shaped housing having an interior surface, and exterior surface, an open first end, an open second end, a length therebetween, and having a longitudinal axis;

a flexible printed circuit board (PCB) sized to fit curved within said cylindrical shaped housing;

a generator of ohmic heat, disposed on said PCB, in thermal proximity to said mouthpiece;

a heat sensor, disposed on said PCB, in thermal proximity to at least a portion of said mouthpiece;

a closed-loop electronic feedback circuit including:

a differential amplifier, disposed on said PCB, comparing a first input proportional to a fixed reference temperature of at least a portion of said mouthpiece to a second input proportional to a sensed temperature of at least a portion of said mouthpiece, said differential amplifier controlling a current i(t) flowing through said generator of ohmic heat to cause said sensed temperature to substantially equal said fixed reference temperature;

wherein temperature of at least a portion of said mouthpiece is maintained even if ambient temperature of said mouthpiece varies; and a power source, electrically coupleable to said generator of ohmic heat, to said heat sensor, and to said closed-loop electronic feedback circuit.

14. The heater system of claim 13, wherein said differential amplifier is operated in positive feedback mode, and has an output coupled to a transistor whose transistor current is said i(t), said i(t) being generated in pulse-width modulation mode.

15. The heater system of claim 13, further including a user-operable control to scale a fraction of said sensed temperature such that a user playing said musical instrument can manually command a change in temperature of at least a portion of said mouthpiece.

16. The heater system of claim 13, wherein in use, a portion of said mouthpiece passes through a longitudinal axis of said cylindrical housing, and has a protruding elongated portion of said mouthpiece inserted coaxially into said leadpipe;

wherein said cylindrical housing is disposed coaxially about a longitudinal axis of said mouthpiece and said leadpipe of said musical instrument.

17. The heater system of claim 13, wherein air space within said cylindrical housing is filled with a heat conducting elastomer to promote thermal heat transfer between said generator of ohmic heat and at least a portion of said mouthpiece coaxially surrounded by said cylindrical housing.

18. The heater system of claim 13, wherein said generator of ohmic heat includes at least one of a length of Nichrome wire, and a resistor.

19. The heater system of claim 13, wherein said closed-loop electronic feedback circuit includes at least one visual indicator confirming generation of heat.

20. The heater system of claim 13, wherein said brass musical instrument is selected from a group consisting of a bugle, a trumpet, a cornet, flugel horn, a piccolo trumpet, a French horn, a trombone, a baritone, a euphonium, and a tuba.

* * * * *